US005595221A

United States Patent [19]

Lagneau

[11] Patent Number: 5,595,221

[45] Date of Patent: Jan. 21, 1997

[54] METERING MACHINE SUITABLE FOR FILLING BOTTLES OF VARYING DIMENSIONS

[75] Inventor: Bernard P. Lagneau, Champforgeuil, France

[73] Assignee: Eastman Kodak Company, Rochester, N.Y.

[21] Appl. No.: 491,796

[22] Filed: Jun. 20, 1995

[30] Foreign Application Priority Data

Jul. 4, 1994 [FR] France ..... 94 08440

[51] Int. Cl.[6] ..... B65B 3/04

[52] U.S. Cl. ..... 141/177; 141/48; 141/180; 141/181

[58] Field of Search ..... 141/48, 63, 156, 141/157, 159, 160, 177–182

[56] References Cited

U.S. PATENT DOCUMENTS

| | | | |
|---|---|---|---|
| Re. 29,482 | 11/1977 | Rosen | 141/160 |
| 2,263,551 | 11/1941 | Armstrong et al. | 141/181 X |
| 3,020,939 | 2/1962 | Donofrio | 141/178 X |
| 3,424,209 | 1/1969 | Settembrini | 141/180 X |
| 3,911,976 | 10/1975 | Rosen | 141/180 X |
| 4,359,075 | 11/1982 | Eberle | 141/177 |
| 5,035,270 | 7/1991 | Herzog | 141/181 X |
| 5,313,990 | 5/1994 | Clusserath | 141/48 X |

FOREIGN PATENT DOCUMENTS 3809347 10/1989 Germany .

*Primary Examiner*—J. Casimer Jacyna
*Attorney, Agent, or Firm*—Susan L. Parulski

[57] ABSTRACT

A machine for the filling bottles, particularly bottles of varying dimensions.

The metering machine comprises two identical devices placed one on top of the other, with combs, allowing the rapid, simple and easy adjustment of the nozzles used for metering, and a device for controlling the cycle which is easy to adjust according to the size of the bottles moved by the conveyor.

5 Claims, 4 Drawing Sheets

METERING MACHINE SUITABLE FOR FILLING BOTTLES OF VARYING DIMENSIONS

FIELD OF THE INVENTION

The present invention relates to the bottling of liquids and more particularly to a machine suitable for filling bottles of different dimensions.

BACKGROUND OF THE INVENTION

In the technology normally used, machines are known for filling bottles, for example machines sold by the company BREITNER. This type of machine is very complex and comprises numerous parts which have to be removed in order to be replaced by other parts when the format of the bottles is changed.

The object of the present invention is to provide a machine for filling bottles which can easily be adapted to a change in the type of bottle.

SUMMARY OF THE INVENTION

The metering machine according to the invention, in order to fill simultaneously a series of identical bottles moved by a continuously operating conveyor and in which a first series of bottles is brought to a first position in which they are immobilised and filled with a neutral atmosphere by means of a first series of nozzles entering the bottles and then moved to a second position in which they are immobilised and filled with a liquid by means of a second series of nozzles entering the bottles; the two series of nozzles being fixed to each other and being driven vertically in order to cause the nozzles to enter the bottles and to withdraw them therefrom and the bottles being in contact with each other when they are on the conveyor in their first and second positions, and guides adjustable in transverse position with respect to the movement of the bottles so as to align the various types of bottle moved by the conveyor underneath the nozzles, a metering machine characterised in that it comprises two practically identical alignment devices disposed one above the other and provided with a guide defining a passage slot allowing the movement of the nozzles in only one dimension parallel to the movement of the bottles in order to be able to adjust the distance between each nozzle and a series of combs each being able to be moved in a practically horizontal plane and perpendicularly to the direction of movement of the bottles in order to immobilise the nozzles in a position suited to the bottles to be filled; a means of stopping the bottles comprising a first device for immobilising the bottles, the position of which with respect to the nozzle situated furthest downstream is equal to half the diameter of the bottles disposed on the conveyor and which is intended to prevent the movement of the two series of bottles, a first cell disposed upstream of the first immobilisation device, the position of which can be adjusted along the path according to the type of bottle moved by the conveyor and intended to check that the two series are complete so as to enable the metering cycle, a second immobilisation device disposed upstream of the first immobilisation device and the position of which can be adjusted along the path according to the type of bottle moved by the conveyor and used to immobilise the first series of bottles when the two complete series of bottles are immobilised by the first immobilisation device and releasing the first series of bottles only when a given period of time, the start of which coincides with the release of the second series of bottles by the first immobilisation device, has elapsed in order to physically separate the first series of bottles from the second series of bottles, and a second cell disposed downstream of the first immobilisation device, the position of which can be adjusted along the path according to the type of bottle moved by the conveyor and intended to indicate that the series of filled bottles has left the second position and to actuate the functioning of the first immobilisation device so as to keep the two series of bottles in an immobile position underneath the nozzles.

BRIEF DESCRIPTION OF THE DRAWINGS

A particular embodiment of a machine according to the invention will now be described with reference to the accompanying drawings in which.

DETAILED DESCRIPTION OF THE INVENTION

Figure 1:
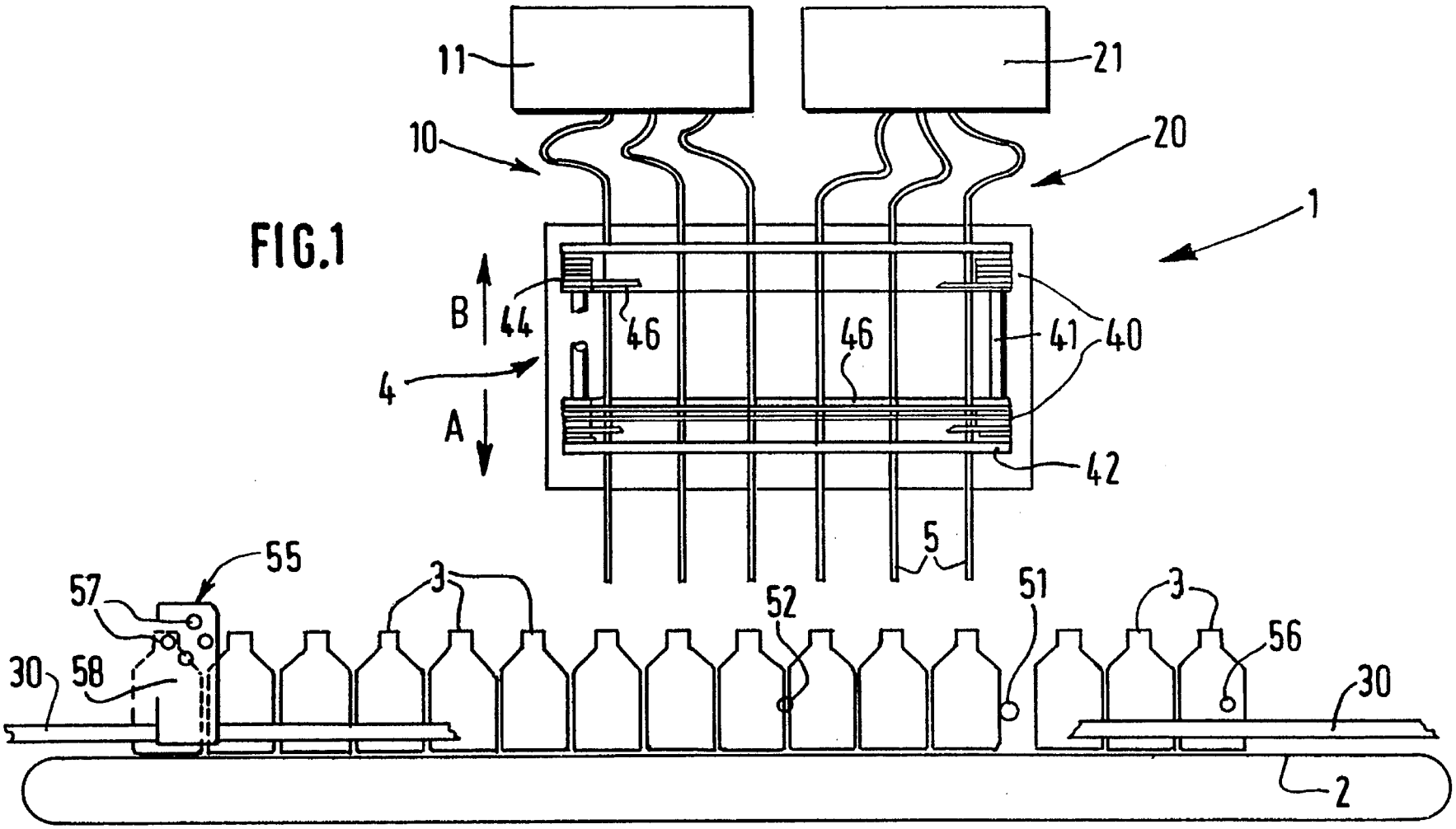
FIG. 1 shows diagrammatically the various functions carried out by a metering machine.

As can be seen in the different figures, the metering machine 1 comprises a conveyor 2 intended to move bottles 3 which are placed thereon. Advantageously, the conveyor is designed so as to move continuously, the movement of the bottles being able to be interrupted by introducing a stop on the path. At this moment, the bottom of the bottle slides on the surface of the conveyor 2.

The metering machine comprises a metering assembly 4, provided with several nozzles 5 suitable for entering the bottles. The entry of the nozzles 5 into the bottles 4 is obtained by a vertical downward movement of the metering assembly 4, shown by the arrow A. The nozzles 5, when they are inside the bottles, serve to introduce the appropriate fluids into the bottles. After filling of the bottles the nozzles are moved to their uppermost position as shown diagrammatically by the arrow B.

In a particular embodiment, the liquid to be packaged in the bottles being sensitive to oxygen, it is necessary to fill the bottles with a neutral atmosphere, for example nitrogen, before filling the bottle with the liquid to be packaged. The metering machine is therefore divided into two parts. A first part 10 comprising a first series of nozzles connected to a reservoir 11 containing a neutral atmosphere, for example nitrogen. A second part 20 comprising a second series of nozzles connected to a reservoir 21 containing the liquid to be packaged. To simplify the operation of the metering machine, the two parts 10 and 20 are fixed to each other.

Advantageously, lateral guides, shown schematically in FIG. 1 by the reference numeral 30, are disposed above the conveyor. These guides enable the neck of the bottle to be directed in correct register with the nozzles.

According to the invention, it is desired to be able to use, on this type of machine, bottles which do not have the same diameter. It is therefore necessary to modify the position of the various nozzles, to adjust the transverse guides and to modify the operating cycle of the metering machine.

Figure 2:
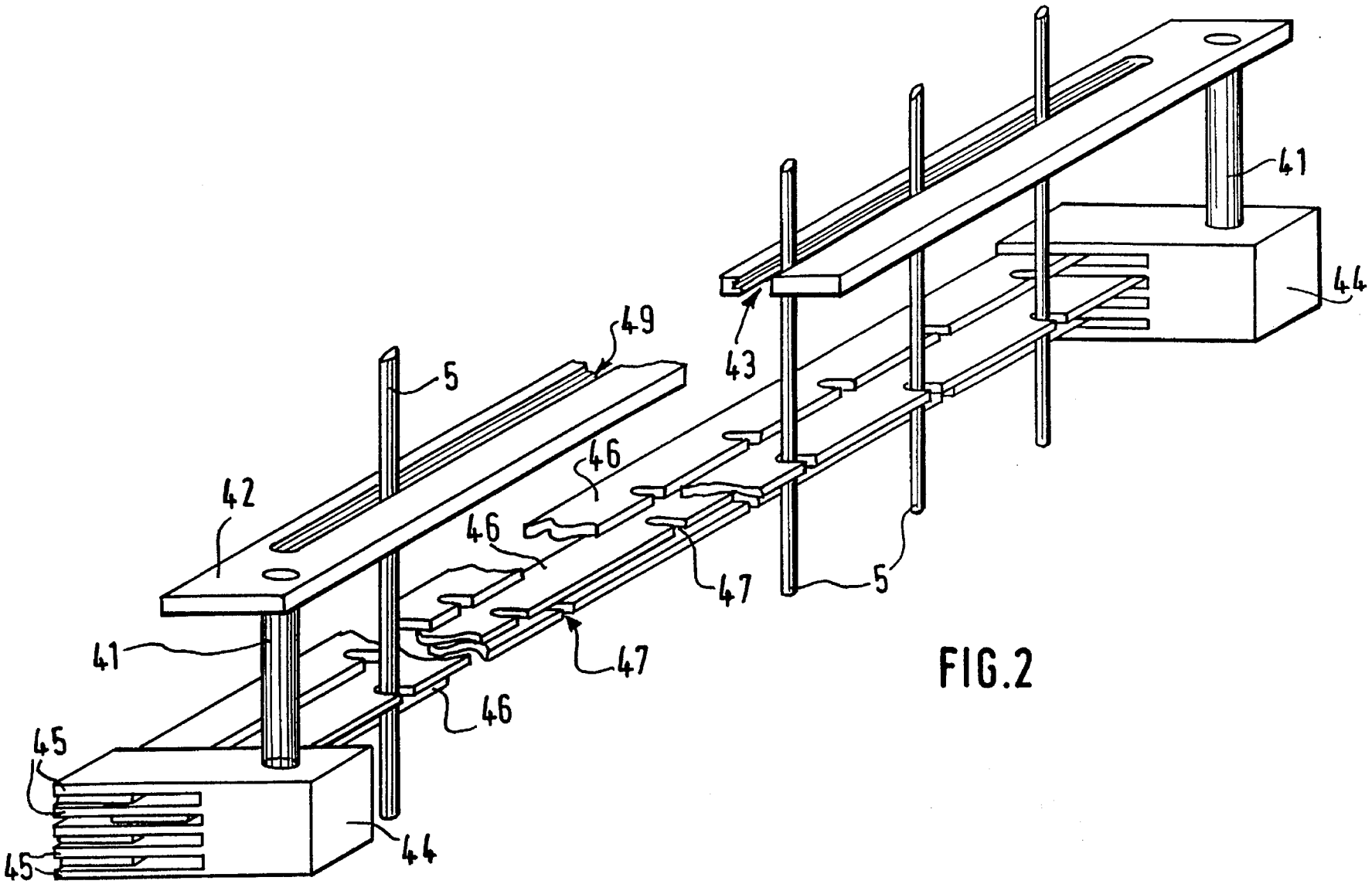
FIG. 2 shows, in perspective and partially cut away, a part of the device for aligning the nozzles according to the invention.

Reference will now be made to FIG. 2, which shows diagrammatically and in perspective a part of an alignment device 40 used in the metering assembly 4. The alignment device 40 comprises a mounting 41, such as, for example, two rods, fixed to the metering assembly 4. This mounting supports, on the one hand, the guide 42 defining a passage slot 43 and, on the other hand, two supports 44.

The passage slot 43 is adapted so as to receive the nozzles 5 and to limit the movement of these nozzles in a direction parallel to the path of movement of the bottles. Advantageously, one of the surfaces 49 of the slot in contact with the nozzles is flexible and deformable so as to exert sufficient force on the nozzles to maintain them in position when they are subjected to any other external force apart from gravity. This arrangement allows an easy positioning of the nozzles by an operator desiring to modify their respective positions.

Advantageously the flexible surface is obtained by means by a strip of rubber.

The supports 44 are provided with fingers 45 on which combs 46 are able to slide in a plane parallel to the conveyor, practically horizontal and in a direction practically perpendicular to the path of the bottles. The combs 46 have cut-outs 47 intended to receive the nozzles 45. Advantageously, each comb 46 is suited to a particular type of bottle. The cut-outs 47 in each comb are spaced apart by a distance equal to the distance between spouts for bottles disposed one against the other on the conveyor.

The embodiment of the alignment device 40 therefore allows an easy change in the relative positions of the nozzles with respect to each other. This positioning is obtained by withdrawing the combs last used, choosing new combs and positioning the nozzles by moving the latter in a direction parallel to the path followed by the bottles and then engaging the nozzles and corresponding combs so as to immobilise the nozzles.

Figure 4:
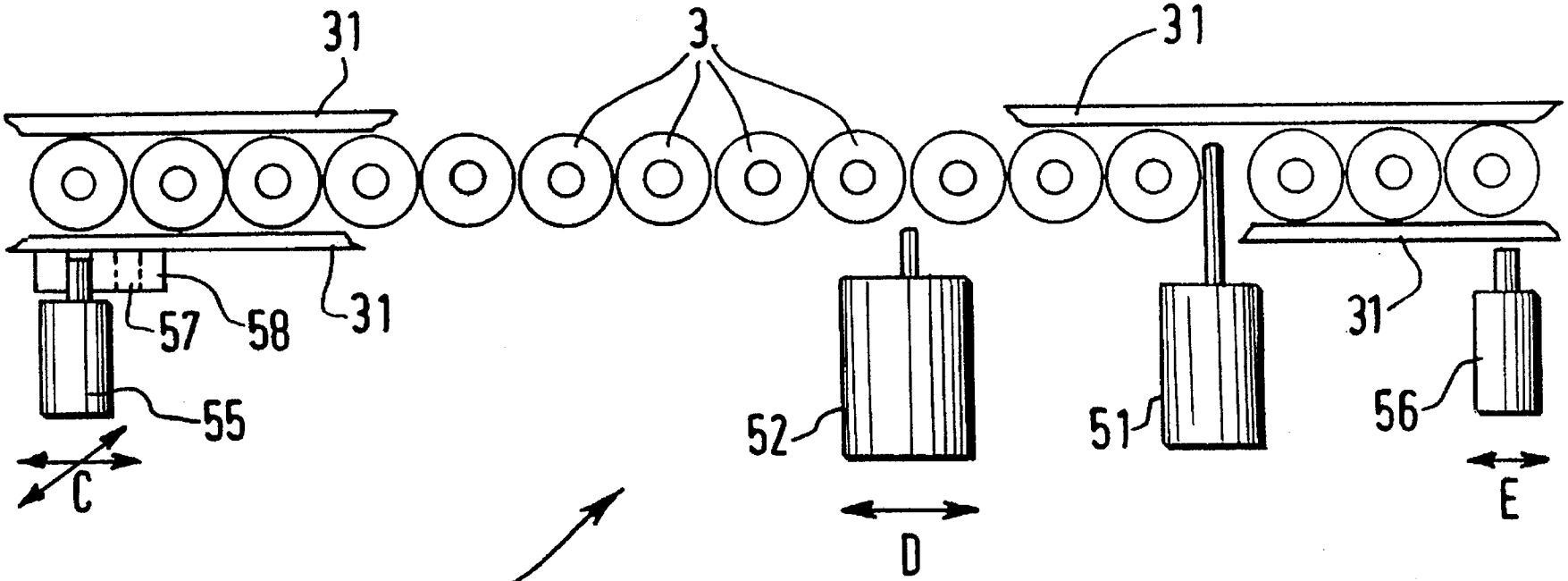

Since the filling of the bottles comprises in reality two distinct filling phases, one with a neutral atmosphere and the other with the product to be packaged, it is necessary to provide a mechanism 50, shown in more detail and in plan view in FIG. 4, to position and immobilise the bottles. This mechanism must be simple, reliable and easy to adjust according to the diameter of the bottles. The mechanism 50 comprises a first immobilisation device such as a ram 51, preferably fixed, the position of which depends on the position of the nozzle which is furthest downstream, and a first cell 55 situated upstream. The cell 55, preferably of the infrared type, receives IR radiation reflected by the bottles. Obviously another type of cell may be used.

The ram 51, when it is in the projecting position, as shown in FIG. 4, is situated on the path of the bottles so as to immobilise them in spite of the continuous operation of the conveyor belt 2. The cell 55 is situated upstream, at a sufficient distance from the ram 51 to ensure that the metering station comprises a sufficient number of bottles. When the bottles are immobilised by the ram 51 and the cell 55 does not detect the presence of bottles, the metering machine is stopped. Advantageously, the number of bottles disposed between the ram 51 and cell 5 affords a self-sufficiency of the machine corresponding to two metering cycles.

Preferably, the cell 55 detects the presence of bottles at the spout. This is shown diagrammatically by the system of orthogonal axes C shown in FIG. 4. In this way it is possible to ensure that the type of bottle disposed on the conveyor corresponds to the desired bottles.

The mechanism 50 also comprises a second immobilisation device such as a ram 52, the position of which can be adjusted along the path (as shown diagrammatically by the double arrow D) according to the type of bottle moved by the conveyor. This second ram 52, disposed upstream of the first ram 51, enables one series of bottles to be separated physically from another series. The second ram 52 is disposed so as to immobilise the series of bottles disposed upstream and into which the neutral atmosphere has been introduced. This ram 52 is put in the extended position during the metering operation. It enables the bottles which are filled with the liquid to be packaged to be separated physically from the bottles which are filled, for example, with nitrogen. Once the metering is finished, the first ram 51 is withdrawn or retracted so as to release the series of bottles full of the liquid to be packaged, whilst the second ram 52 is in the extended position. This enables the conveyor 2 to physically separate the bottles full of liquid from the bottles full of nitrogen. After a given period, the second ram 52 is retracted (as shown in FIG. 4), thus releasing the other bottles. The conveyor 2 then moves all the bottles.

A second cell 56, disposed downstream of the first ram 51 at a distance approximating to the number of bottles filled with the liquid to be packaged, enables the passage of the said bottle to be detected. The position of this cell 56 must be adjusted by a movement shown diagrammatically by the double arrow E in FIG. 4, according to the type of bottle moved by the conveyor 2. This detection actuates the first ram 51, which is returned to an extended position so as to prevent the movement of the bottles to be filled. After immobilisation of the bottles, the metering operation can commence and the second ram can be disposed in the extended position in order to be able to separate the full bottles physically from the bottles to be filled. Because of the relatively low precision which is of the order of a mm, the relative positioning of the second ram 52 and second cell 56 is obtained by register adjustment with a visual index. However, the use of a finger entering a recess formed in a guide rail can be envisaged. The positioning of the first cell 55 serving to detect the neck of the bottles can be obtained by means of a template 58 with holes 57 produced in a thick plate. The cell is disposed inside a cylindrical part able to enter the holes in the template according to the type of bottle which it is intended to move by means of the conveyor 2. The use of a template with holes enables the position of the first cell 55 to be modified very easily.

The modified metering machine according to the invention allows the use of bottles with different diameters. It is therefore necessary to provide bottle guides 30 adjustable in position so that the necks of these bottles always follow the same path within the metering station. This unique path makes it possible not to have to modify the position of the nozzles in two directions at right angles to each other.

Figure 3:
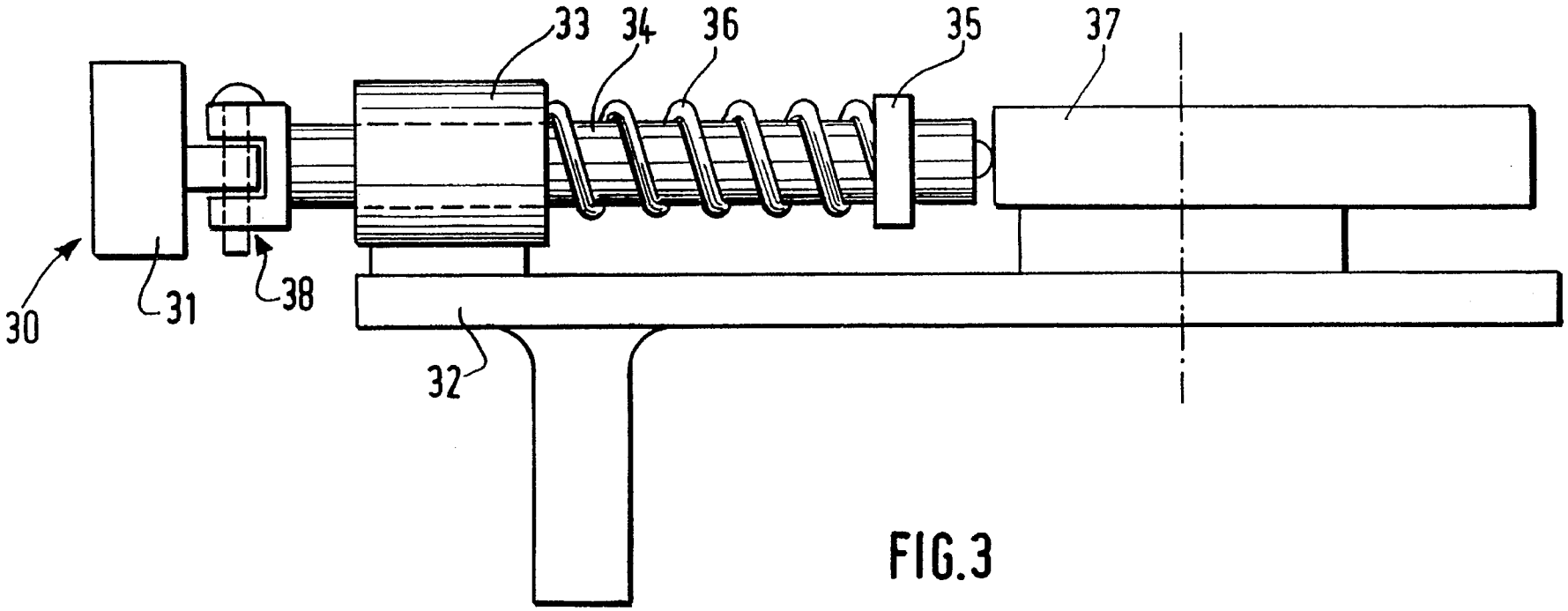
FIGS. 3 and 4 show an embodiment of the mechanism for positioning and immobilising the bottles which can be used in the invention.

Advantageously, the guides consist of bars 31 able to be moved perpendicularly to the path of the bottles in a plane parallel to the plane of the conveyor. In a particularly advantageous embodiment the ends of each bar 31 are provided with a position adjustment system. The adjustment system can take the form shown diagrammatically in FIG. 3. A support 32 fixed to the frame of the dosing machine holds a sleeve 33 so that its axis is practically perpendicular to the path followed by the bottles and in a plane parallel to the plane of the conveyor. A rod 34 connected to the bar 31 is able to slide in the sleeve 33. Advantageously the bar 31 is pivoted at 38 on the rod 34. The rod 34 has a collar 35 against which a spring 36 comes to bear. The rod 34 is thus pushed so as to come into contact with a cam 37 rotatably mounted on the support 32. Advantageously, the cam 37 may be in the form of an eccentric disc. The cam 37 may have, at its top, reference marks as well as recesses in which a pin affording the locking of the cam in its desired position is able to fit. Obviously any other adjustment device may be used. The adaptation of the metering machine according to the invention when the bottles to be filled are being changed takes only a very short time, approximately 30 seconds.

If desired, position sensors can be disposed at the cells 55 and 56, ram 52, guide bars 31 and combs 46. The sensors can be connected to a control device, such as, for example, a microprocessor, so as to alert the operator and prevent the operation of the metering machine if the various components to be adjusted are not all disposed in their position corresponding to the same type of bottle.

We claim:

1. A metering machine for filling a plurality of bottles including a first and second series of bottles, said metering machine comprising:

a continuously operating conveyor moving the bottles along a first direction between a first position and a second position, said bottles having a first diameter;

a first series of nozzles for filling the first series of bottles with a neutral atmosphere at said first position;

a second series of nozzles for filling the second series of bottles with a liquid at said second position, said first and second series of nozzles being movable in a second direction between a filling position and a non-filling position, said second direction being substantially perpendicular to said first direction, said first series of nozzles being rigidly affixed to said second series of nozzles;

a first device for immobilizing the second series of bottles at said second position, said first immobilizing device disposed downstream of said first and second series of nozzles;

a second device for immobilizing the first series of bottles at said first position, said second immobilizing device disposed upstream of said first immobilizing device and adjustable in said first direction;

guides adjustable in a transverse position relative to said first direction to align the bottles with said first and second series of nozzles;

a first and second alignment device disposed one above the other for adjusting the distance between each nozzle, each of said first and second alignment devices being provided with a guide defining a passage slot allowing the movement of said first and second series of nozzles in a direction parallel with said first direction, each of said first and second alignment devices including a series of combs receiving and immobilizing said first and second series of nozzles, said combs being slideable in a plane substantially parallel to the conveyor and movable in said second direction;

a first cell disposed upstream of said first immobilization device to detect the presence of the first and second series of bottles on the conveyor, said first cell being adjustable in said first direction; and a second cell disposed downstream of said first immobilization device to detect the passage the second series of bottles from said second position, said second cell being adjustable in said first direction.

2. The metering machine according to claim 1 wherein said passage slot includes a flexible and deformable surface exerting sufficient force on said first and second series of nozzles to maintain the position of said first and second series of nozzles.

3. The metering machine according to claim 2 wherein the deformable surface is comprised of a rubber material.

4. The metering machine according to claim 1 wherein said first and second immobilization devices are rams.

5. The metering machine according to claim 1 wherein said combs include a plurality of cut-outs spaced apart by a distance approximately equal to said first diameter, each cut-off intended to receive a nozzle.

* * * * *